US010474089B2

(12) United States Patent
Furukawa

(10) Patent No.: US 10,474,089 B2
(45) Date of Patent: Nov. 12, 2019

(54) WASTE TONER-STORING CONTAINER AND IMAGE FORMING APPARATUS

(71) Applicant: TOSHIBA TEC KABUSHIKI KAISHA, Tokyo (JP)

(72) Inventor: Kimiaki Furukawa, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/202,011

(22) Filed: Nov. 27, 2018

(65) Prior Publication Data

US 2019/0243299 A1 Aug. 8, 2019

(30) Foreign Application Priority Data

Feb. 8, 2018 (JP) ..... 2018-021387

(51) Int. Cl.
*G03G 21/12* (2006.01)
*G03G 15/08* (2006.01)
*G03G 21/10* (2006.01)

(52) U.S. Cl.
CPC ..... *G03G 21/12* (2013.01); *G03G 15/0865* (2013.01); *G03G 21/105* (2013.01)

(58) Field of Classification Search
CPC ..... G03G 21/10; G03G 21/105; G03G 21/12; G03G 15/0865; G03G 2221/1624
USPC ..... 399/360
See application file for complete search history.

(56) References Cited

U.S. PATENT DOCUMENTS 7,848,667 B2 12/2010 Ishi
2006/0120760 A1* 6/2006 Fujioka ..... G03G 15/0893 399/227
2007/0258733 A1* 11/2007 Yoshida ..... G03G 15/0877 399/254
2015/0147090 A1* 5/2015 Sato ..... G03G 21/105 399/110
2017/0023908 A1* 1/2017 Miura ..... G03G 21/105
2017/0060074 A1* 3/2017 Mizutani ..... G03G 21/12

FOREIGN PATENT DOCUMENTS

JP 06194997 A * 7/1994

* cited by examiner

*Primary Examiner* — Sophia S Chen
(74) *Attorney, Agent, or Firm* — Kim & Stewart LLP

(57) ABSTRACT

In accordance with an embodiment, a waste toner-storing container includes a container main body and a backflow-preventing member. A first storing chamber of the container main body includes a first storing space capable of storing an amount of waste toner discharged from a main body of an image forming apparatus, which is below a predetermined threshold. A second storing chamber of the container main body includes a second storing space that stores waste toner overflowing from the first storing space and discharged from the first storing chamber if the amount of waste toner exceeds the predetermined threshold. The backflow-preventing member prevents waste toner stored in the second storing space from moving into the first storing chamber.

10 Claims, 6 Drawing Sheets

WASTE TONER-STORING CONTAINER AND IMAGE FORMING APPARATUS

CROSS-REFERENCE TO RELATED APPLICATION

This application is based upon and claims the benefit of priority from the prior Japanese Patent Application No. 2018-021387, filed on Feb. 8, 2018, the entire contents of which are incorporated herein by reference.

FIELD

An embodiment described here generally relates to a waste toner-storing container and an image forming apparatus.

BACKGROUND

An image forming apparatus forms an image by transferring a toner image onto a sheet. The toner image is formed on a photoreceptor. Thereafter, the toner image is primarily transferred to an intermediate transfer belt by a primary transfer unit. The primarily transferred toner image is secondarily transferred to the sheet by a secondary transfer unit. The toner image secondarily transferred to the sheet is fixed on the sheet by a fixing unit. Untransferred toner remains on the photoreceptor after primary transfer. The untransferred toner is removed from the photoreceptor by a photoreceptor cleaner. The toner removed by the photoreceptor cleaner is collected in a waste toner-storing container. Untransferred toner remains on the intermediate transfer belt also after secondary transfer. The untransferred toner is removed from the intermediate transfer belt by an intermediate transfer belt cleaner. The toner removed by the intermediate transfer belt cleaner is collected in the waste toner-storing container. The waste toner-storing container is provided with a waste toner-detecting sensor. The waste toner-detecting sensor detects a height of waste toner deposited in the waste toner-storing container. For example, when the waste toner-detecting sensor detects that the waste toner-storing container is completely filled with the waste toner, the image forming apparatus displays a message for urging to exchange the waste toner-storing container. Since overflow of the waste toner causes malfunction, the image forming apparatus stops an image forming operation. In some cases, a user detaches the waste toner-storing container and shakes the detached waste toner-storing container and/or turns the detached waste toner-storing container upside down. In those cases, the height of the deposited waste toner changes. When the waste toner-storing container is reattached to the image forming apparatus, there is a fear that the waste toner-detecting sensor may erroneously detect that the waste toner-storing container is not completely filled with the waste toner. In this case, the image forming apparatus is enabled to restart image forming. However, there is a problem in that overflow of waste toner may cause malfunction.

DETAILED DESCRIPTION

In accordance with an embodiment, a waste toner-storing container stores waste toner discharged from an image forming apparatus. The waste toner-storing container includes a container main body, a first storing chamber, a second storing chamber, and a backflow-preventing member. The container main body is removably attached to a main body of the image forming apparatus in a first posture. The first storing chamber is provided in the container main body. The first storing chamber includes an introduction port that receives waste toner discharged from the main body of the image forming apparatus when the container main body is in the first posture. The first storing chamber further includes a first storing space capable of storing an amount of waste toner introduced through the introduction port, which is below a predetermined threshold. The second storing chamber is provided in the container main body. The second storing chamber includes an inner discharge port that discharges waste toner overflowing from the first storing space from the first storing chamber if the amount of waste toner introduced through the introduction port exceeds the predetermined threshold when the container main body is in the first posture. The second storing chamber further includes a second storing space that stores waste toner discharged from the inner discharge port. The backflow-preventing member is arranged between the inner discharge port and the second storing space. The backflow-preventing member prevents waste toner stored in the second storing space from moving into the first storing chamber.

Hereinafter, waste toner-storing containers and image forming apparatuses according to embodiments will be described with reference to the drawings. In each figure, the same reference signs denote the same or similar portions.

First Embodiment

Figure 1:
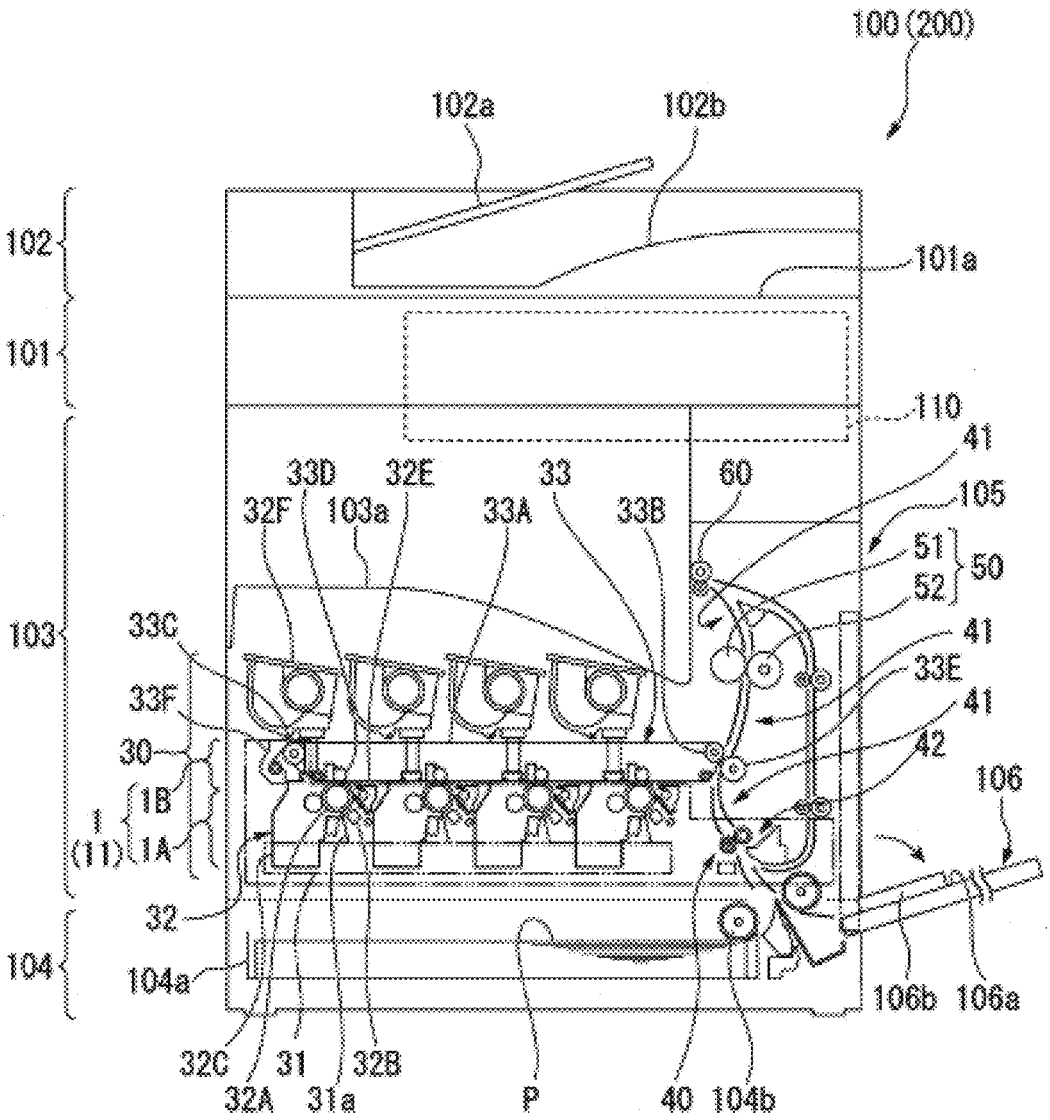
FIG. 1 is a cross-sectional view schematically showing a configuration example of an image forming apparatus according to a first embodiment.

FIG. 1 is a cross-sectional view schematically showing a configuration example of an image forming apparatus according to a first embodiment. In FIG. 1, the dimension and shape of each member are exaggerated or simplified for the sake of clarity (same applies to the subsequent figures).

The image forming apparatus 100 according to the first embodiment shown in FIG. 1 is an multi-function peripherals (MFP), for example. The image forming apparatus 100 may be a printer, a copying machine, or the like, for example. The image forming apparatus 100 includes a scanner 101, an auto document feeder (ADF) 102, a printer 103, a sheet feed device 104, a reversing device 105, a manual sheet feed device 106, and a controller 110. The image forming apparatus 100 includes an exterior cover (not shown). Hereinafter, the configuration of the image forming apparatus 100 will be described on the basis of the arrangement posture shown in FIG. 1. The image forming apparatus 100 shown in FIG. 1 is installed in a horizontal plane. The height direction of FIG. 1 is a vertical direction. The front portion of the image forming apparatus 100 is oriented to the front of the sheet in FIG. 1. The right side (right side of the figure) as viewed in a direction facing the front portion of the image forming apparatus 100 corresponds to a right side of the image forming apparatus 100. The left side (left side of the figure) as viewed in the direction facing the front portion of the image forming apparatus 100 corresponds to the left side of the image forming apparatus 100. Although not specially shown in the figure, the deep side of the sheet in FIG. 1 is a rear portion of the image forming apparatus 100. Unless otherwise set forth herein, the terms "front", "rear or back", "upper or up", "lower or down", "left", "right", and the like will be used regarding relative positions of the members constituting the image forming apparatus 100 on the basis of the above-mentioned arrangement posture of the image forming apparatus 100. Therefore, the terms "front", "rear or back", "upper or up", "lower or down", "left", "right", and the like can be different from those in the positional relationship shown in the drawings.

The scanner 101 reads a document (not shown). A document tray 101*a* on which the document is to be placed is provided in an upper portion of the scanner 101. The ADF 102 is provided above the document tray 101*a*. The ADF 102 conveys the document placed on the document-placing unit 102*a* to a document-scanning position of the scanner 101. The document conveyed to the document-scanning position is discharged to a document-discharging tray 102*b* beneath the document-placing unit 102*a*.

The scanner 101 includes an illumination light source (not shown) that illuminates the document with light and an image sensor (not shown) that photoelectrically converts light reflected from the document. The scanner 101 reads information of the document fed by the ADF 102 or the document placed on the document tray 101*a* by using the illumination light source and the image sensor. Although not shown in the figure, an operating panel (operating unit) for the user to operate the operation of the image forming apparatus 100 is provided on the front side of the figure of the scanner 101. For example, the operating panel includes an operation panel with various keys and a touch panel display.

The printer 103 (main body of the image forming apparatus) and the sheet feed device 104 are provided beneath the scanner 101 in the stated order. The sheet feed device 104 delivers a sheet P on which an image is to be formed to the printer 103. The sheet feed device 104 includes a sheet feed cassette 104*a*. The sheet feed device 104 shown in FIG. 1 includes a single sheet feed cassette 104*a*, for example. However, the sheet feed device 104 may include a plurality of sheet feed cassettes 104*a*. The sheet feed cassette 104*a* stores sheets P of various sizes by using the centers thereof as a reference. Moreover, the sheet feed device 104 includes sheet feed rollers 104*b*. The sheet feed rollers 104*b* feed the sheet P toward a conveyance path inside the printer 103 from the sheet feed cassette 104*a*.

The printer 103 forms an image on the sheet P on the basis of the image data read by the scanner 101 or image data generated by a personal computer or the like. The printer 103 is a color printer using a tandem system, for example. The printer 103 includes an image-forming device 30, a conveying device 40, a fixing unit 50, and sheet discharge rollers 60. Moreover, the printer 103 includes a front cover (not shown) as the exterior cover. The front cover can be opened on the front side of the figure. When the front cover is opened, an operator can attach and detach various apparatus parts provided to be attachable and detachable inside the printer 103 on the front side of the figure. For example, the operator can attach and detach a waste toner-storing container 1 to be described later by opening the front cover.

The image-forming device 30 forms an image on the sheet P with toner of various colors of yellow (Y), magenta (M), cyan (C), and black (K). The image-forming device 30 includes an exposure unit 31, imaging units 32, a transfer unit 33, and the waste toner-storing container 1.

The exposure unit 31 generates exposure light 31*a*. The exposure light 31*a* forms latent images corresponding to images of the respective colors on four photosensitive drums 32A included in the imaging units 32 to be described later. An exposure unit that scans the photosensitive drums 32A by using laser light from a semiconductor laser device may be used as the exposure unit 31. An exposure unit including a solid-state scanning device such as an LED may be used as the exposure unit 31 instead of the semiconductor laser device.

The imaging units 32 include the four photosensitive drums 32A that are image carriers. The photosensitive drums 32A are arranged rightward in parallel spaced apart from one another. The photosensitive drums 32A are each rotationally driven in the clockwise direction in the figure by a driving motor (not shown). The imaging units 32 each include a charging unit 32B, a developing unit 32C, and a photoreceptor cleaner 32E in each of outer peripheral portions of the photosensitive drums 32A. The charging unit 32B, the developing unit 32C, and the photoreceptor cleaner 32E are arranged in the stated order in a rotation direction of each photosensitive drum 32A. The imaging units 32 are arranged above the exposure unit 31. Latent images and toner images corresponding to the images of the respective colors of Y, M, C, and K in order from the left are formed on the four photosensitive drums 32A. The charging units 32B, the developing units 32C, and the photoreceptor cleaners 32E in the imaging units 32 have similar configurations except for differences of toner colors to be used for imaging.

The charging unit 32B uniformly charges the surface of the photosensitive drum 32A. The charged photosensitive drum 32A is irradiated with the exposure light 31*a* modulated on the basis of the image data. An electrostatic latent image is formed on the photosensitive drum 32A.

The developing unit 32C charges toner inside the unit. The developing unit 32C includes a developing roller. A developing bias is applied on the developing roller. The developing unit 32C delivers charged toner to the surface of the photosensitive drum 32A by using the developing roller. When toner is supplied to the surface of the photosensitive drum 32A, the electrostatic latent image on the photosensitive drum 32A is developed with the toner. Toner cartridges 32F are arranged above the developing units 32C with the transfer unit 33 provided therebetween. In this embodiment, the four toner cartridges 32F that supply toner of the respective colors of Y, M, C, and K are arranged. A toner replenishing unit (not shown) is provided between the toner cartridges 32F and the developing unit 32C. Toner inside the toner cartridges 32F is supplied to the developing unit 32C by the toner replenishing unit.

The photoreceptor cleaner 32E removes toner remaining on the photosensitive drum 32A, which has not been primarily transferred by the transfer unit 33 to be described later, from the surface of the photosensitive drum 32A. For example, the photoreceptor cleaner 32E includes a cleaning blade to come into contact with the photosensitive drum 32A. The cleaning blade removes the remaining toner on the surface of the photosensitive drum 32A. The photoreceptor cleaner 32E includes a waste toner-discharging pipe (not shown) that discharges the removed toner to the waste toner-storing container 1.

The transfer unit 33 is arranged above the photosensitive drums 32A to face the photosensitive drums 32A. The transfer unit 33 forms the toner image (primary transferred image) of the respective colors by sequentially transferring (primarily transferring) the toner images formed on the surfaces of the photosensitive drums 32A. Moreover, the transfer unit 33 forms the toner image on the sheet P by transferring (secondarily transferring) the primary transferred image on the sheet P. The transfer unit 33 includes an intermediate transfer belt 33A, a driving roller 33B, driven rollers 33C, primary transfer rollers 33D, a secondary transfer roller 33E, and an intermediate transfer belt cleaner 33F.

The intermediate transfer belt 33A is stretched by the driving roller 33B and the plurality of driven rollers 33C to be long in left and right directions in FIG. 1. The driving roller 33B is rotationally driven in the counter-clockwise direction in the figure by the driving motor (not shown). When the driving roller 33B is driven, the intermediate transfer belt 33A endlessly travels in the counter-clockwise direction in the figure. The linear velocity of the intermediate transfer belt 33A is controlled in a manner that depends on the speed (processing speed) at which the toner images are formed on the photosensitive drums 32A. The processing speed is set in advance. A lower surface of the intermediate transfer belt 33A comes into contact with upper surfaces of the photosensitive drums 32A in the figure.

Inside the intermediate transfer belt 33A, the primary transfer rollers 33D are respectively arranged at positions facing the photosensitive drums 32A. When a primary transfer voltage is applied, the primary transfer rollers 33D primarily transfer the toner images on the photosensitive drums 32A to the intermediate transfer belt 33A.

The secondary transfer roller 33E faces the driving roller 33B with the intermediate transfer belt 33A provided therebetween. When the sheet P passes between the driving roller 33B and the secondary transfer roller 33E, a secondary transfer voltage is applied on the secondary transfer roller 33E. When the secondary transfer voltage is applied, the secondary transfer roller 33E secondarily transfers the toner images on the intermediate transfer belt 33A to the sheet P.

The intermediate transfer belt cleaner 33F is arranged near the driven rollers 33C at the left end portion of the figure. The intermediate transfer belt cleaner 33F removes toner remaining on the intermediate transfer belt 33A, which has not been secondarily transferred to the sheet P, from the intermediate transfer belt 33A. For example, the intermediate transfer belt cleaner 33F includes the cleaning blade to come into contact with the intermediate transfer belt 33A. The cleaning blade removes the remaining toner on the surface of the intermediate transfer belt 33A. The intermediate transfer belt cleaner 33F includes a waste toner-discharging pipe (not shown) that discharges removed toner to the waste toner-storing container 1 to be described later.

The waste toner-storing container 1 (container main body) stores waste toner discharged from the photoreceptor cleaners 32E and the intermediate transfer belt cleaner 33F. The waste toner-storing container 1 is arranged inside the printer 103. The waste toner-storing container 1 is positioned beneath the toner cartridges 32F and in front of the imaging unit 32 in the figure. The waste toner-storing container 1 is provided inside the printer 103 so as to be attached and detached by the user on the front side by opening the front cover (not shown) of the printer 103 forward. A detailed configuration of the waste toner-storing container 1 will be described after description of the entire configuration of the image forming apparatus 100.

The conveying device 40 conveys the sheet P fed from the sheet feed cassette 104*a* in a first conveyance direction (upper direction in the figure) along a first conveyance path 41 inside the printer 103. The first conveyance path 41 includes a plurality of conveyance and guide members. The first conveyance path 41 guides conveyance of the sheet P. The first conveyance path 41 is provided between the sheet feed rollers 104*b* and the above-mentioned secondary transfer position, between the secondary transfer position and the fixing unit 50 to be described later, and between the fixing unit 50 and the sheet discharge rollers 60 to be described later.

The conveying device 40 includes registration rollers 42. The registration rollers 42 are arranged in the first conveyance path 41 between the sheet feed rollers 104*b* and the secondary transfer position. The registration rollers 42 are driven by the driving motor (not shown). The registration rollers 42 adjust the position of the edge of the sheet P in the first conveyance direction under a rotation-stopped condition. When the registration rollers 42 are rotationally driven by the driving motor, the registration rollers 42 convey the sheet P in the first conveyance direction. The linear velocity of the registration rollers 42 is controlled such that the toner image formed on the intermediate transfer belt 33A and the edge of the sheet P reach the secondary transfer position in synchronization with each other.

The fixing unit 50 fixes, on the sheet P, the toner image transferred to the sheet P after passing the secondary transfer position. The fixing unit 50 is arranged above the secondary transfer roller 33E. The fixing unit 50 includes a fixing member 51 and a pressing member 52. The fixing member 51 and the pressing member 52 form a nip (fixing nip) by being held in contact with each other. The fixing member 51 and the pressing member 52 nips the sheet P conveyed through the first conveyance path 41 at the fixing nip. The fixing member 51 heats the sheet P at the fixing nip. For example, a tubular endless belt or roller is used as the fixing member 51. A heating source of the fixing member 51 is not particularly limited as long as the surface temperature of the fixing member 51 can be controlled to be a fixing temperature. The pressing member 52 presses the sheet P at the fixing nip. For example, a tubular endless belt or roller is used as the pressing member 52.

At least one of the fixing member 51 or the pressing member 52 is rotationally driven by the driving motor (not shown). When the driving motor rotates, the sheet P nipped by the fixing member 51 and the pressing member 52 is conveyed in the first conveyance direction at fixing speed depending on the processing speed.

The sheet discharge rollers 60 are provided at the end portion of the first conveyance path 41 above the fixing unit 50. The first conveyance path 41 is curved leftward in the upper direction in the figure above the fixing unit 50. In the figure, a sheet discharge tray 103*a* is provided on the left side of the sheet discharge rollers 60. The sheet discharge tray 103*a* is located above the image-forming device 30 and beneath the scanner 101.

The sheet discharge rollers 60 are rotationally driven by the driving motor (not shown) so as to be rotatable forward and backward. When the sheet discharge rollers 60 are rotated forward, the sheet P conveyed through the first conveyance path 41 is further conveyed to the sheet discharge tray 103*a* by the sheet discharge rollers 60. When the sheet discharge rollers 60 are continuously rotated forward, the sheet P is discharged to the sheet discharge tray 103*a*.

The sheet discharge rollers 60 are a pair of rollers, for example. When the sheet discharge rollers 60 are rotated backward while the sheet P is put between the pair of rollers of the sheet discharge rollers 60, the sheet P is conveyed (switched back) rightward along the route of the end portion of the first conveyance path 41. In this case, the sheet discharge rollers 60 are capable of conveying the sheet P to the reversing device 105 to be described later.

The reversing device 105 turns over the sheet P switched back after passing the fixing unit 50 to have the top surface facing downward and feeds the sheet P to the registration rollers 42 again. The reversing device 105 is used for duplex printing.

The manual sheet feed device 106 delivers the sheet P manually appropriately set for image forming to the printer 103. In the following description, a direction in which the manual sheet feed device 106 moves the sheet P for delivering the sheet P to the printer 103 will be referred to as a second sheet feed direction.

In the example of FIG. 1, the second sheet feed direction is the left direction in the figure.

The manual sheet feed device 106 includes a manual sheet feed tray 106*a* and a manual guide 106*b*. The manual sheet feed tray 106*a* is provided to be rotatable about a rotational axis extending in a direction orthogonal to the second sheet feed direction. When the manual sheet feed device 106 is used, the manual sheet feed tray 106*a* is rotated in the arrow direction (clockwise direction) shown in the figure and retained at a position (position shown in FIG. 1) at which the manual sheet feed tray 106*a* projects from the side portion of the casing of the image forming apparatus 100. When the manual sheet feed device 106 is not used, the manual sheet feed tray 106*a* is housed at a position overlapping the reversing device 105 (position shown by the long dashed double-dotted line in FIG. 1) in the side portion of the casing of the image forming apparatus 100. The manual guide 106*b* includes wall-like members extending in parallel in the second sheet feed direction and opposite to each other in the direction orthogonal to the second sheet feed direction. The manual guide 106*b* positions sheets P of various sizes to be set on the manual sheet feed tray 106*a* by using the centers thereof as a reference. A sheet feed method for the sheets P in the manual sheet feed device 106 is not particularly limited as long as a roller sheet feed system is used.

The controller 110 controls operations of the apparatus parts of the image forming apparatus 100 in accordance with operation inputs from an operating device (not shown). For example, the controller 110 includes a CPU, a ROM (read only memory), a random access memory (RAM), an input/output interface, an input/output control circuit, a sheet feed/sheet conveyance control circuit, an image-forming control circuit, and a fixing control circuit. The CPU realizes a processing function for image forming by executing programs stored in the ROM or the RAM. The input/output control circuit in the controller 110 controls the operation panel of the operating device and the display. The sheet feed/sheet conveyance control circuit controls driving of various driving motors included in the sheet feed device 104, the reversing device 105, the printer 103, the sheet discharge rollers 60, and the reversing device 105. The image-forming control circuit controls operations of the ADF 102, the scanner 101, and the image-forming device 30 in accordance with control signals from the CPU. Control to be performed by the image-forming control circuit includes full-state detection of the waste toner-storing container 1 to be described later and operation control of the image forming apparatus 100 which is based on the full-state detection. The fixing control circuit controls the operation of the driving motor of the fixing unit 50 and the temperature of the fixing member 51 on the basis of control signals from the CPU.

Figure 2:
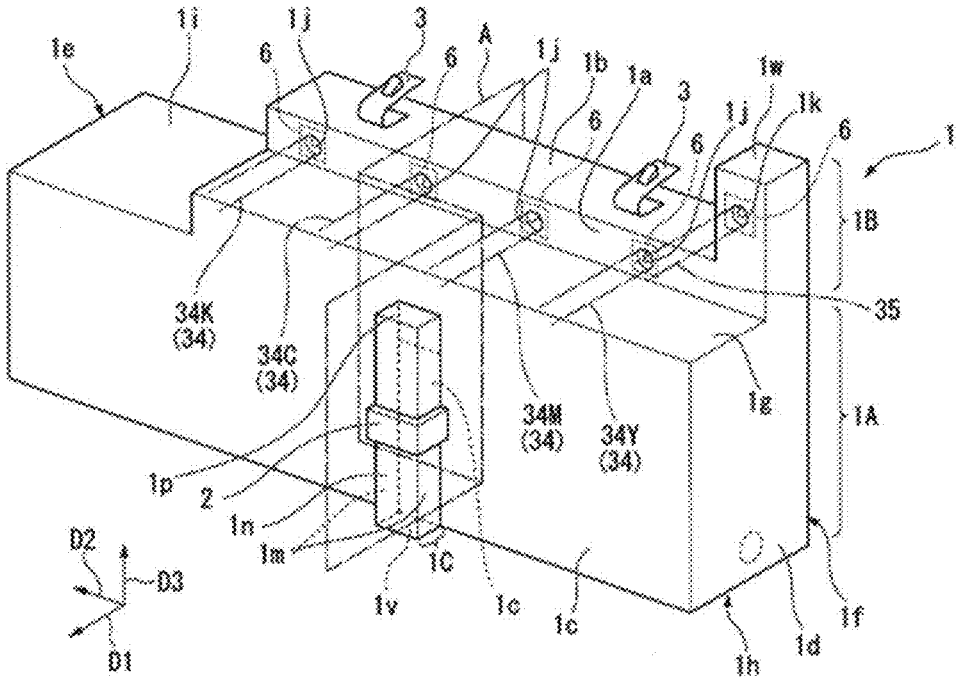
FIG. 2 is a perspective view schematically showing a configuration example of a waste toner-storing container according to the first embodiment.
Figure 3:
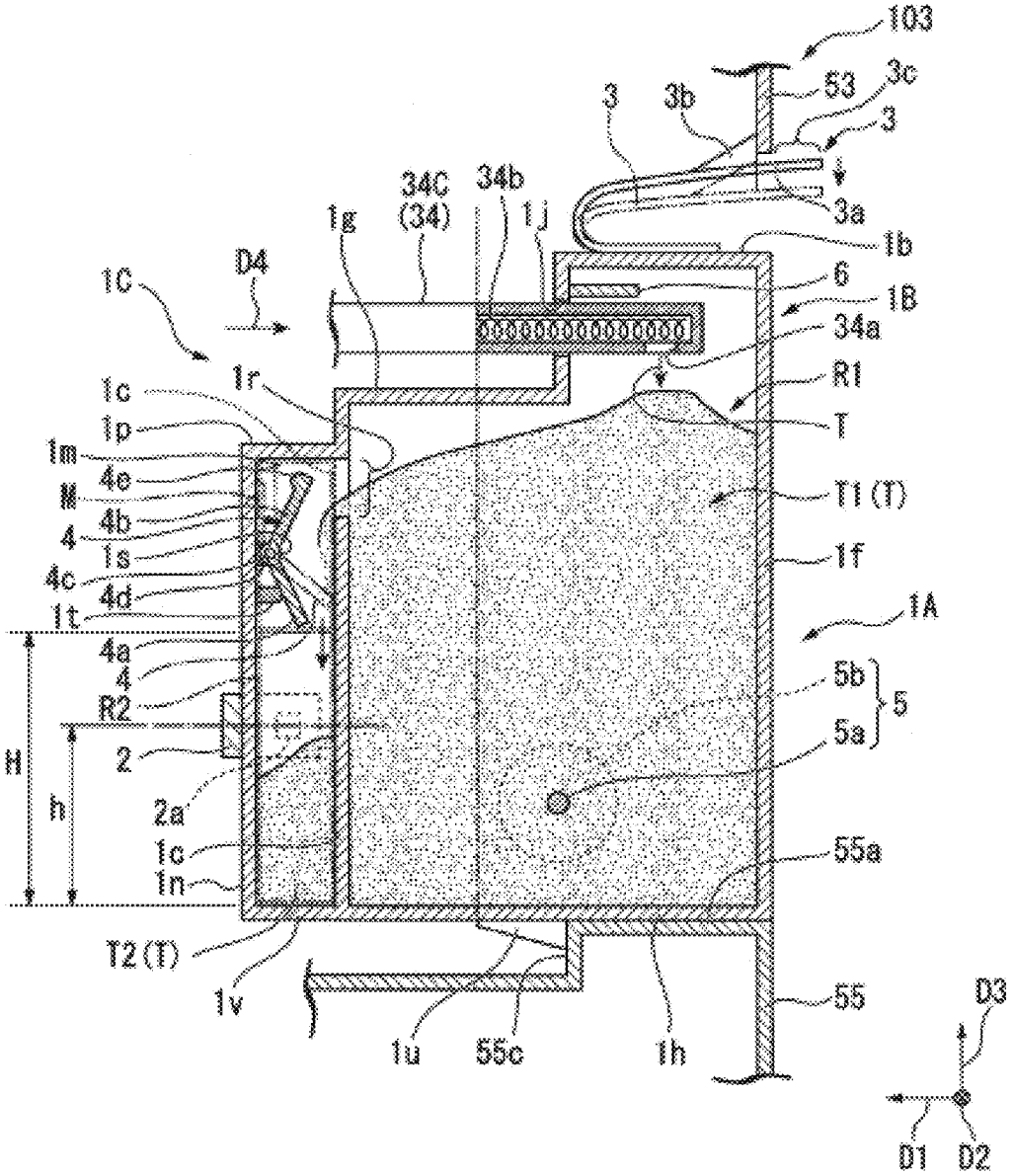
FIG. 3 is an A-A cross-sectional view schematically showing a configuration example of the waste toner-storing container which is taken along the plane A of FIG. 2.

Here, a detailed configuration of the waste toner-storing container 1 will be described. FIG. 2 schematically shows a configuration example of the waste toner-storing container according to the first embodiment. FIG. 3 schematically shows a configuration example of an A-A cross-section of FIG. 2.

The waste toner-storing container 1 is in a predetermined first posture (see FIGS. 1 to 3) when the waste toner-storing container 1 is attached to the printer 103. It should be noted that a posture obtained by rotating the posture shown in FIGS. 1 to 3 around the vertical axis is also the first posture. The waste toner-storing container 1 can be in a posture different from the first posture (hereinafter, referred to as a second posture) when the waste toner-storing container 1 is detached from the printer 103. Hereinafter, unless otherwise set forth herein, a detailed configuration of the waste toner-storing container 1 based on the first posture will be described. In FIG. 2 (same applies to other figures), the arrow D1 indicates the rear direction in the image forming apparatus 100. The arrow D2 indicates the right direction in the image forming apparatus 100. The arrow D3 indicates the upper direction in the image forming apparatus 100.

As shown in FIG. 2, the waste toner-storing container 1 includes a main body section 1A (first storing chamber), a collector pipe-inserting section 1B (first storing chamber), and a detection toner-storing section 1C (second storing chamber).

As shown in FIG. 2, the main body section 1A is a casing having an approximately cuboid shape long in the left and right directions and short in front and rear directions. Further, as shown in FIG. 1, an upper end portion of the main body section 1A is lower than a lower end of the transfer unit 33. As shown in FIG. 2, the main body section 1A includes a lower surface portion 1*h*, a rear surface portion 1*c*, a front surface portion 1*f*, a left surface portion 1*d*, and a right surface portion 1*e*. The upper end portion of the main body section 1A is covered with a first upper surface portion 1*g*, a second upper surface portion 1*i*, and the collector pipe-inserting section 1B. The lower surface portion 1*h* is a flat plate having a rectangular shape long in the D2 direction. The lower surface portion 1*h* has a shorter-side width that can be provided in a space between the image-forming device 30 and the front cover (not shown) of the image forming apparatus 100. The rear surface portion 1*c* and the front surface portion 1*f* are flat plates erected from shorter-side end portions of the lower surface portion 1*h*. The rear surface portion 1*c* faces the image-forming device 30 when being attached to the image forming apparatus 100. The front surface portion 1*f* faces the front cover when the waste toner-storing container 1 is attached to the image forming apparatus 100. The left surface portion 1*d* and the right surface portion 1*e* respectively form left and right side walls of the main body section 1A. The front surface portion 1*f* and the left surface portion 1*d* extend to the collector pipe-inserting section 1B to be described later. The front surface portion 1*f* and the left surface portion 1*d* extending in the range of the collector pipe-inserting section 1B form the front portion and the left surface portion of the collector pipe-inserting section 1B, respectively.

As shown in FIG. 2, the first upper surface portion 1*g* of the main body section 1A forms a left upper end portion of the waste toner-storing container 1 together with the collector pipe-inserting section 1B to be described later. The left upper end portion of the waste toner-storing container 1 has a width with which the waste toner-storing container 1 can face the entire imaging unit 32 in the left and right directions. The first upper surface portion 1*g* is a flat plate forming the left upper end portion of the waste toner-storing container 1. The second upper surface portion 1*i* extends to the right side of the first upper surface portion 1*g* and the collector pipe-inserting section 1B via a step lowered than right end portions of the first upper surface portion 1*g* and the collector pipe-inserting section 1B. The second upper surface portion 1*i* extends to a rightmost end portion of the waste toner-storing container 1 from the right end portions of the first upper surface portion 1*g* and the collector pipe-inserting section 1B.

As shown in FIG. 2, the collector pipe-inserting section 1B is provided in contact with a front end of the first upper surface portion 1*g*. The collector pipe-inserting section 1B projects above the first upper surface portion 1*g*. The collector pipe-inserting section 1B includes, at an upper portion thereof, a third upper surface portion 1*b* and a fourth upper surface portion 1*w* in the stated order from the right. The third upper surface portion 1*b* is higher than the first upper surface portion 1*g*. The fourth upper surface portion 1*w* is higher than the third upper surface portion 1*b*. A space between the third upper surface portion 1*b* and the fourth upper surface portion 1*w* is covered with a step (not shown). The collector pipe-inserting section 1B has an L-shape as viewed in the front and rear directions. The front of the collector pipe-inserting section 1B is closed by the front surface portion 1*f* extending upward. A rear portion 1*a* extends on the rear side of the collector pipe-inserting section 1B. The rear portion 1*a* covers a space among the first upper surface portion 1*g*, the third upper surface portion 1*b*, and the fourth upper surface portion 1*w*. The rear portion 1*a* is a flat plate parallel to the rear surface portion 1*c*. It should be noted that four first insertion holes 1*j* (introduction port) and a single second insertion hole 1*k* (introduction port) penetrate the rear portion 1*a* in a plate thickness direction of the rear portion 1*a*.

End portions of the waste toner-discharging pipes 34Y, 34M, 34C, and 34K can be inserted into the first insertion holes 1*j*, respectively. Thus, the first insertion holes 1*j* are formed at positions in the rear portion 1*a*, which respectively correspond to positions of the end portions of the waste toner-discharging pipes 34Y, 34M, 34C, and 34K protruding forward from the image forming apparatus 100. In this embodiment, the first insertion holes 1*j* are formed in the rear portion 1*a* beneath the third upper surface portion 1*b*. Hereinafter, the waste toner-discharging pipes 34Y, 34M, 34C, and 34K will be sometimes referred to as waste toner-discharging pipes 34 if the waste toner-discharging pipes 34Y, 34M, 34C, and 34K do not need to be distinguished from one another. An end portion of a waste toner-discharging pipe 35 can be inserted into the second insertion hole 1*k*. The second insertion hole 1*k* is formed at a position in the rear portion 1*a*, which corresponds to the position of the end portion of the waste toner-discharging pipe 35 protruding forward from the image forming apparatus 100. In this embodiment, the second insertion hole 1*k* is formed in the rear portion 1*a* beneath the fourth upper surface portion 1*w*. The first insertion holes 1*j* and the second insertion hole 1*k* are respectively closed by movable shields 6 provided inside the waste toner-storing container 1. It should be noted that when the waste toner-discharging pipes 34 and the waste toner-discharging pipe 35 are inserted into the first insertion holes 1*j* and the second insertion hole 1*k*, respectively, the movable shields 6 are retracted inward as shown in FIG. 3.

Now, the waste toner-discharging pipes 34 and 35 will be described. The waste toner-discharging pipes 34Y, 34M, 34C, and 34K are provided on the front side of the photoreceptor cleaners 32E (see FIG. 1) that remove the remaining toner from the photosensitive drums 32A that form the toner images of the respective colors of Y, M, C, and K. The waste toner-discharging pipes 34 extend along a forwardly extending axis of the image forming apparatus 100. The waste toner-discharging pipes 34 are parallel to one another at least at the end portions in an extending direction. The waste toner-discharging pipes 34 all have similar configurations. Hereinafter, a configuration common to the waste toner-discharging pipes 34 will be described by exemplifying the waste toner-discharging pipe 34C shown in FIG. 3.

As shown in FIG. 3, a waste toner conveyance member 34*b* is arranged inside the waste toner-discharging pipe 34C. The waste toner conveyance member 34*b* is rotationally driven around a central axis of the waste toner-discharging pipe 34C by a driving source (not shown). The waste toner conveyance member 34*b* is rotationally driven to move waste toner collected in the photoreceptor cleaner 32E forward inside the waste toner-discharging pipe 34C (see the arrow D4 of FIG. 3) The waste toner conveyance member 34*b* is not particularly limited as long as the waste toner conveyance member 34*b* is rotationally driven to be capable of moving waste toner. For example, a screw, a rotary paddle, a helical coil, or the like may be used as the waste toner conveyance member 34*b*. A discharge port 34*a* shown in FIG. 3 is an opening portion for discharging the waste toner, which is moved forward by the waste toner conveyance member 34*b*, from the end portion of the waste toner-discharging pipe 34C. The discharge port 34*a* is formed at the end portion of the waste toner-discharging pipe 34C. When the waste toner-storing container 1 is attached to the image forming apparatus 100, the end portion of the waste toner-discharging pipe 34C is located within the waste toner-storing container 1. A forming position and an opening direction of the discharge port 34*a* are not limited as long as the discharge port 34*a* is within the range of the end portion of the waste toner-discharging pipe 34C. In the example shown in FIG. 3, the discharge port 34*a* is opened downward at the end portion of the waste toner-discharging pipe 34C to be inserted into the waste toner-storing container 1.

The waste toner-discharging pipe 35 shown in FIG. 2 is provided on the front side of the intermediate transfer belt cleaner 33F (See FIG. 1). The waste toner-discharging pipe 35 extends along the forwardly extending axis of the image forming apparatus 100. The waste toner-discharging pipe 35 is parallel to the waste toner-discharging pipes 34 at least at the end portions in the extending direction. Although not particularly shown, the waste toner-discharging pipe 35 has a configuration similar to that of each waste toner-discharging pipe 34 except for insertion into the second insertion hole 1*k*. Specifically, the same waste toner conveyance member as the waste toner conveyance member 34*b* is provided inside the waste toner-discharging pipe 35. The same discharge port as the discharge port 34*a* is formed at the end portion of the waste toner-discharging pipe 35.

The waste toner-storing container 1 will be further described. As shown in FIG. 3, the waste toner-storing container 1 is placed on a placement table portion 55 on the front side of the printer 103 when the waste toner-storing container 1 is attached to the printer 103. A locking step 55*c* lowered than a placement surface 55*a* is formed in the placement table portion 55. An opening portion 1*s* formed above the placement table portion 55. The waste toner-storing container 1 can be inserted into the opening portion from the front. A locking plate 53 projecting downward is provided in a part of the opening portion. A locking claw 1*u* is formed in the lower surface portion 1*h* of the waste toner-storing container 1. Two or more locking claws 1*u* are more favorably provided in a longer-side direction of the lower surface portion 1*h*. The locking claw 1*u* is a protrusion protruding downward from the lower surface portion 1*h*. As shown in FIG. 3, the locking claw 1*u* has a triangular shape having a height lower in the rear direction as viewed in the left and right directions. The locking claw 1*u* is locked with the locking step 55*c* of the placement table portion 55 from the back. The locking claw 1*u* positions the attachment position of the waste toner-storing container 1 in the front and rear directions.

Clampers 3 that attach and detach the waste toner-storing container 1 to/from the printer 103 are provided in the third upper surface portion 1*b* of the waste toner-storing container 1. As shown in FIG. 2, the clampers 3 are provided at two positions spaced apart from each other in the left and right directions on the third upper surface portion 1*b*. The clampers 3 have the same shape. As shown in FIG. 3, each of the clampers 3 includes a clamping lever 3*a*, a locking claw 3*b*, and a pressing portion 3*c*. The clamping lever 3*a* is a J-shaped curved plate curved on the rear side as viewed in the left and right directions. The clamping lever 3*a* is made of an elastic material such as resin and metal, for example. The locking claw 3*b* is a protrusion formed in an upper surface. The protrusion is located on the rear side of an end of the clamping lever 3*a*. The locking claw 3*b* has a triangular shape having a height lower in the rear direction as viewed in the left and right directions. The locking claw 3*b* is provided at a position where locking claw 3*b* can be locked with the locking plate 53 of the printer 103 in the front and rear directions when the waste toner-storing container 1 is attached to the printer 103. The pressing portion 3*c* is a part of the clamping lever 3*a*. Specifically, the pressing portion 3*c* is a portion of the clamping lever 3*a*, which is located in front of the locking claw 3*b*. The pressing portion 3*c* is used for a lock-cancelling operation of the locking claw 3*b*. In the lock-cancelling operation, the operator presses the pressing portion 3*c* downward. The locking claw 3*b* is moved beneath the locking plate 53 and the lock of the locking claw 3*b* is cancelled (see the long dashed double-dotted line in FIG. 3).

As shown in FIG. 3, a first storing space R1 that is a continuous inner space is formed inside the main body section 1A and the collector pipe-inserting section 1B. The first storing space R1 stores waste toner T introduced through the first insertion holes 1*j* and the second insertion hole 1*k* and discharged from the discharge ports 34*a*. Hereinafter, the waste toner T deposited on the lower surface portion 1*h* within the first storing space R1 will be sometimes referred to as waste toner T1. The capacity of the first storing space R1 is larger than an allowable storage amount V1 that is a threshold based on which whether or not the waste toner T1 reaches an upper-limit amount is determined. The allowable storage amount V1 is defined in advance as an amount that does not prevent discharge of the waste toner T from the waste toner-discharging pipes 34 and 35 inserted in the collector pipe-inserting section 1B. For example, the allowable storage amount V1 is more favorably smaller than the volume of the main body section 1A.

As shown in FIG. 3, a stirring member 5 is provided inside the main body section 1A. The stirring member 5 stirs the waste toner T1 stored in the first storing space R1. The stirring member 5 stirs the waste toner T1 to thereby overcome an uneven distribution of the waste toner T1 in the first storing space R1. Therefore, even if different quantities of the waste toner T are discharged from the waste toner-discharging pipes 34 and 35, the upper surface of the deposit of the waste toner T is made substantially even. The stirring member 5 includes a rotational shaft 5*a* and a stirring blade 5*b*, for example. The rotational shaft 5*a* extends in the left and right directions. Both end portions of the rotational shaft 5*a* are supported to be rotatable with bearings (not shown). The bearings are provided in the left surface portion 1*d* and the right surface portion 1*e*. The bearings are sealed for preventing leakage of the waste toner T1. Although not particularly shown, an end portion of the rotational shaft 5*a* extends outside the left surface portion 1*d* or the right surface portion 1*e*. The end portion of the rotational shaft 5*a* which extends outside receives rotational driving force transmitted from an internal driving source (not shown) of the printer 103 when the waste toner-storing container 1 is attached to the printer 103. When the rotational shaft 5*a* is rotated, the stirring blade 5*b* rotates together with the rotational shaft 5*a*. The stirring blade 5*b* stirs the waste toner T in the first storing space R1.

As shown in FIG. 2, the detection toner-storing section 1C is formed at an intermediate portion 1*n* the left and right directions on the rear surface portion 1*c* of the main body section 1A. The detection toner-storing section 1C has a rectangular outer shape long in the upper and lower directions. The detection toner-storing section 1C includes a lower surface portion 1*v*, two side surface portions 1*m*, a rear surface portion 1*n*, and an upper surface portion 1*p*. The lower surface portion 1*v* is a flat plate portion having a rectangular shape as viewed from above. The lower surface portion 1*v* is formed in such a manner that a part of the lower surface portion 1*h* of the main body section 1A extends on the rear side of the rear surface portion 1*c*. The side surface portions 1*m* are flat plate portions extending upward from both end portions of the lower surface portion 1*v* in the left and right directions. Front end portions of the side surface portions 1*m* are connected to the rear surface portion 1*c* of the main body section 1A. The side surface portions 1*m* are opposite to each other in the left and right directions. The height of the side surface portions 1*m* from the lower surface portion 1*v* is lower than the height of the first upper surface portion 1*g* from the lower surface portion 1*h* of the main body section 1A. The rear surface portion 1*n* is connected to a rear end of the lower surface portion 1*v* and rear ends of the side surface portions 1*m*. The rear surface portion 1*n* is a flat plate portion parallel to the rear surface portion 1*c* of the main body section 1A. The upper surface portion 1*p* is connected to upper ends of the side surface portions 1*m* and the rear surface portion 1*n* and to the rear surface portion 1*c* of the main body section 1A. The upper surface portion 1*p* is a flat plate portion parallel to the lower surface portion 1*v*, for example. It should be noted that the upper surface portion 1*p* may be formed of a plate-like portion having a tilted surface or a curved surface.

As shown in FIG. 3, an inner discharge port 1*r* communicating with the first storing space R1 is formed in an upper part of the rear surface portion 1*c* of the main body section 1A, which constitutes a part of the detection toner-storing section 1C. When the waste toner-storing container 1 is in the first posture, the waste toner T deposited above the lower end of the inner discharge port 1*r* in the first storing space R1 can overflow into the detection toner-storing section 1C from the inner discharge port 1*r*. The waste toner T overflowing from the inner discharge port 1*r* moves to the bottom of the detection toner-storing section 1C by gravity.

The shape of the inner discharge port 1*r* is not particularly limited. For example, the inner discharge port 1*r* may be a rectangular opening.

A second storing space R2 is formed in the inner bottom of the detection toner-storing section 1C. The second storing space R2 is surrounded by the lower surface portion 1*v*, the side surface portions 1*m*, the rear surface portion 1*n*, and the rear surface portion 1*c* beneath a lower end portion of the inner discharge port 1*r*. The second storing space R2 is capable of storing a predetermined amount of waste toner T overflowing from the inner discharge port 1*r*. Hereinafter, the waste toner T deposited on the lower surface portion 1*v* in the second storing space R2 will be sometimes referred to as waste toner T2. The amount of deposited waste toner T2 in the second storing space R2 is used for full-state detection of the waste toner-storing container 1. For example, the second storing space R2 is formed in the range of a height H from the lower surface portion 1*v*. The height h is lower than the height of the lower end of the inner discharge port 1*r* from the lower surface portion 1*v*.

The shape of the second storing space R2 is not particularly limited as long as the amount of deposited waste toner T2 can be easily detected. In this embodiment, the shape of the second storing space R2 is a vertically-long, square columnar shape extending in the vertical direction on the lower surface portion 1*v*, for example. Since the second storing space R2 is vertically long, the area of the upper surface of the deposit of the deposited waste toner T2 is narrower. Therefore, variations in the upper surface of the waste toner T2 due to flapping and the like of the waste toner T2 are reduced. As a result, the amount of deposited waste toner T2 can be accurately known by measuring the upper surface of the deposit of the waste toner T2 in the second storing space R2.

The space from the upper end of the second storing space R2 to the inner discharge port 1*r* is a movement path M through which the waste toner T can pass. The movement path m includes a backflow-preventing member 4. When the waste toner-storing container 1 is in the first posture, the backflow-preventing member 4 enables the waste toner T to move from the inner discharge port 1*r* to the second storing space R2 by its own weight. Moreover, when the waste toner-storing container 1 is in the second posture, the backflow-preventing member 4 closes the movement path m. The second posture is a posture of the waste toner-storing container 1 in which the waste toner T2 flows out of the second storing space R2 by the weight of the waste toner T2.

The backflow-preventing member 4 includes a valve body 4*a*, a rotating shaft 4*c*, a bearing portion 4*d*, and a rotating arm 4*b*. The valve body 4*a* is a plate-like member rotatable within the movement path m and capable of closing the movement path m at a predetermined rotation angle. The rotating shaft 4*c* is provided at a first end portion of the valve body 4*a*. The central axis of the rotating shaft 4*c* is a center of rotation of the valve body 4*a*. The bearing portion 4*d* is fixed to an inner part of the rear surface portion 1*n* of the detection toner-storing section 1C. The bearing portion 4*d* rotatably supports the rotating shaft 4*c*. The bearing portion 4*d* supports the rotating shaft 4*c* to be parallel to an axis extending in the left and right directions.

The rotating arm 4*b* is a plate-like member extending from the first end portion of the valve body 4*a* in an oblique direction crossing the extending direction of the valve body 4*a*. Therefore, the backflow-preventing member 4 is formed in a V-shape having the rotating shaft 4*c* as a top. The shape of the rotating arm 4*b* is not particularly limited as long as the rotating arm 4*b* is rotatable within the movement path m. It should be noted that the mass of the rotating arm 4*b* is larger than the mass of the valve body 4*a*. Moreover, a distance between the center of mass of the rotating arm 4*b* and the central axis of the rotating shaft 4*c* is larger than a distance between the center of mass of the valve body 4*a* and the central axis of the rotating shaft 4*c*.

Such a relationship between the mass and the center of mass is satisfied and each center of mass is eccentric from the central axis of the rotating shaft 4*c*. Therefore, the backflow-preventing member 4 is rotated around the rotating shaft 4*c* by the moment due to gravity. In this embodiment, the length of the rotating arm 4*b* and the length of the valve body 4*a* are substantially the same as viewed in the left and right directions, for example. It should be noted that an end portion of the rotating arm 4*b* (end portion opposite to the first end portion of the valve body 4*a*) is provided with the weight portion 4*e*. The weight portion 4*e* is provided for increasing the mass of the rotating arm 4*b*.

As shown in FIG. 3, a stopper it protrudes inside the rear surface portion 1*n* of the detection toner-storing section 1C. The stopper it locks the valve body 4*a* at a predetermined position when the valve body 4*a* is rotated in a direction toward the rear surface portion 1*n* (rotated in the clockwise direction in the figure). The stopper it restricts rotation of the valve body 4*a* in the in the direction toward the rear surface portion 1*n*. As shown in FIG. 3, when the waste toner-storing container 1 is in the first posture, the moment due to gravity acts on the backflow-preventing member 4 in the clockwise direction in the figure. The valve body 4*a* is locked by the stopper it. In this case, the valve body 4*a* is tilted in an oblique direction falling in the front direction. A second end portion (end portion) opposite to the first end portion of the valve body 4*a* forms a gap with the rear surface portion 1*c* of the main body section 1A. Also, at least a part of the inner discharge port 1*r* faces the front of the rotating arm 4*b*. The rotating arm 4*b* is tilted in an oblique direction rising in the front direction.

An inner surface of the rear surface portion 1*n* of the detection toner-storing section 1C, which is above the bearing portion 4*d*, restricts the limit of rotation of the weight portion 4*e* of the rotating arm 4*b* when the rotating arm 4*b* of the backflow-preventing member 4 is rotated in the direction toward the rear surface portion 1*n* (rotated in the counter-clockwise direction in the figure). In this embodiment, as shown as the long dashed double-dotted line in FIG. 3, when the backflow-preventing member 4 is rotated in the counter-clockwise direction in the figure and the valve body 4*a* closes the movement path m, the weight portion 4*e* is held in contact with the rear surface portion 1*n* or is slightly spaced apart from the rear surface portion 1*n*. Therefore, the weight portion 4*e* is not held in contact with the rear surface portion 1*n* before the movement path m is closed.

As shown in FIG. 2, a waste toner amount-detecting sensor 2 is attached to an outer peripheral portion of the detection toner-storing section 1C. The waste toner amount-detecting sensor 2 detects the amount of deposited waste toner T2 in the detection toner-storing section 1C. The kind of waste toner amount-detecting sensor 2 is not particularly limited as long as the amount of deposited waste toner T2 in the detection toner-storing section 1C can be detected. In this embodiment, the waste toner amount-detecting sensor 2 detects whether the upper surface of the deposit of the waste toner T2 in the second storing space R2 reaches a predetermined height in the first posture. For example, the waste toner amount-detecting sensor 2 can include a transmission type or reflection type optical sensor and the like. The waste toner amount-detecting sensor 2 shown in FIGS. 2 and 3 includes a transmission type optical sensor such as a photointerrupter, for example. The waste toner amount-detecting sensor 2 includes sensor portions 2*a* including a pair of a light-emitting portion and a light-receiving portion (see FIG. 3).

As shown in FIGS. 2 and 3, the sensor portions 2*a* are arranged sandwiching each side surface portion 1*m* of the detection toner-storing section 1C in the left and right directions in a range overlapping the second storing space R2 as viewed in the left and right directions. The side surface portions 1*m* at a site at which at least the sensor portions 2*a* are arranged are made of a transparent material through which detection light of the sensor portions 2*a* can transmit. Light having a wavelength which is blocked by the waste toner T2 is used as the detection light of the sensor portions 2*a*. For example, the waste toner amount-detecting sensor 2 generates binary signals having different signal levels in a manner that depends on whether or not the intensity of detection light from the light-emitting portion 1*s* larger than a predetermined threshold. For example, the signal level in the waste toner amount-detecting sensor 2 may be high if the intensity of detection light is larger than the threshold and may be low if the intensity of detection light is equal to or smaller than the threshold. The waste toner amount-detecting sensor 2 is positioned such that the intensity of detection light is equal to the threshold when the upper surface of the deposit of the waste toner T2 reaches the height h from the lower surface portion 1*v* (where h<H). Here, the height h is associated with the amount of deposited waste toner T2 overflowing from the inner discharge port 1*r* to the second storing space R2 by the time the waste toner T1 stored in the first storing space R1 reaches the allowable storage amount V1. The relationship between the allowable storage amount V1 and the height h can be, for example, determined in advance by experiment, flow analysis of waste toner, and the like.

Figure 4:
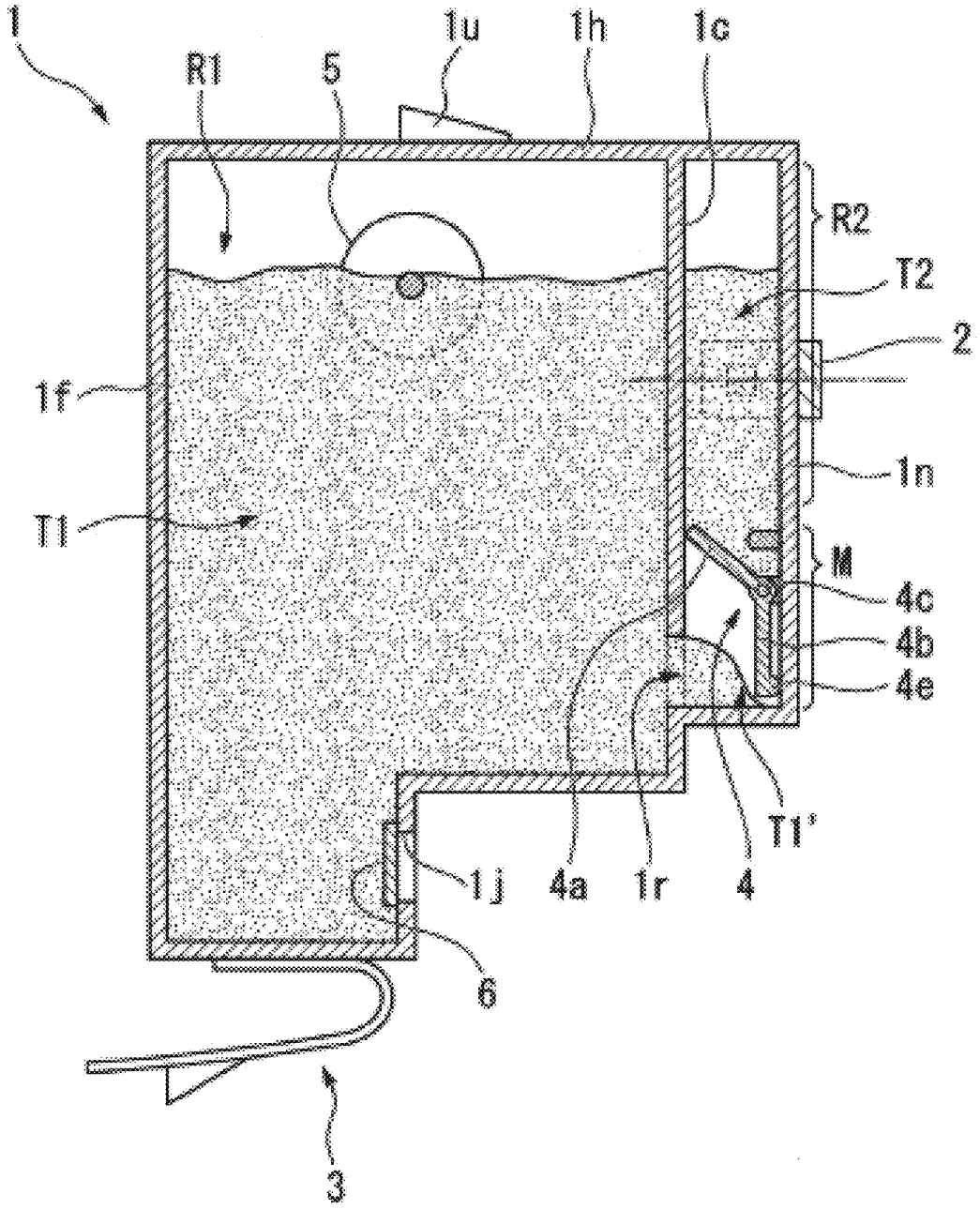
FIG. 4 is an operation explanatory diagram of the waste toner-storing container according to the first embodiment.

Next, actions of the waste toner-storing container 1 in the image forming apparatus 100 will be described. FIG. 4 is an operation explanatory diagram of the waste toner-storing container 1 according to the first embodiment.

The waste toner-storing container 1 is attached to the printer 103 before image forming is started by the image forming apparatus 100. The waste toner-storing container 1 is inserted into the opening portion between the placement table portion 55 and the locking plate 53 from the front of the printer 103 with the front cover opened while the rear surface portion 1*c* is directed on the rear side. As shown in FIG. 3, the operator (not shown) inserts the waste toner-storing container 1 inserted beneath the locking plate 53 while depressing the pressing portions 3*c* of the clampers 3. The waste toner-storing container 1 is pushed in until the locking claw 1*u* is locked with the locking step 55*c*. When the operator stops depressing the pressing portion 3*c*, the locking claws 3*b* are pushed up due to elasticity of the clampers 3. The locking claws 3*b* are locked with the rear side of the locking plate 53. The attachment of the waste toner-storing container 1 is thus completed. Under the attachment condition, the waste toner-storing container 1 is in the first posture.

The image forming apparatus 100 shown in FIG. 1 performs image forming on the sheet P in accordance with an operator's operation or an operation instruction from an external device connected to the image forming apparatus 100. The image forming apparatus 100 performs image forming in well-known electronic photography on the basis of an image signal. The image signal is generated by the scanner 101 reading a document or is sent from the external device. The image-forming device 30 of the image forming apparatus 100 sequentially performs processes of charging, exposure (forming of a latent image), development, primary transfer, and cleaning on the photosensitive drums 32A along with rotation of the photosensitive drums 32A. The charging unit 32B charges the photosensitive drums 32A. The exposure unit 31 exposes the photosensitive drums 32A to light by irradiating the charged photosensitive drums 32A with the exposure light 31*a* modulated in accordance with the image signal. Electrostatic latent images are formed on the surface of the photosensitive drum 32A. The developing unit 32C develops the electrostatic latent images with toner. The primary transfer rollers 33D primarily transfer the toner images on the photosensitive drums 32A to the intermediate transfer belt 33A. The photoreceptor cleaner 32E removes toner remaining on the photosensitive drums 32A, which is not primarily transferred to the intermediate transfer belt 33A. When the toner in the developing unit 32C is reduced, toner is additionally supplied from the toner cartridges 32F. The above-mentioned processes are performed by the imaging units 32 that form the toner images of the respective colors of Y, M, C, and K. The transfer unit 33 conveys the overlapping toner images in the colors, which are primarily transferred, to the secondary transfer position by rotationally driving the intermediate transfer belt 33A.

The image forming apparatus 100 feeds the sheet P from the sheet feed device 104 or the manual sheet feed device 106 in parallel with such an imaging process. The fed sheet P is conveyed to the secondary transfer position by the conveying device 40. At the secondary transfer position, the toner images on the intermediate transfer belt 33A are sequentially secondarily transferred to the sheet P by the secondary transfer roller 33E. When the secondary transfer is completed, the remaining toner on the intermediate transfer belt 33A is removed by the intermediate transfer belt cleaner 33F. The sheet P to which the toner images are secondarily transferred is conveyed to the fixing unit 50. The fixing unit 50 fixes the toner images on the sheet P. The sheet P on which the toner image is fixed is discharged to the sheet discharge tray 103*a* by the sheet discharge rollers 60, for example. The image forming on the sheet P is thus completed. Further, the sheet P on which the toner image is fixed may be conveyed to the reversing device 105 via the sheet discharge rollers 60 for image forming on the back surface.

As described above, in the image-forming process, the photoreceptor cleaners 32E and the intermediate transfer belt cleaner 33F respectively remove toner remaining on the photosensitive drums 32A and the intermediate transfer belt 33A. The removed toner is discharged to the waste toner-storing container 1 through the waste toner-discharging pipes 34 and 35 as the waste toner T.

For example, as shown in the example of the waste toner-discharging pipe 34C in FIG. 3, the waste toner T falls from the discharge ports 34*a* and is stored as the waste toner T1 in the first storing space R1. As shown in FIG. 3, when the upper surface of the deposit of the waste toner T1 exceeds the height of the lower end of the inner discharge port 1*r*, the waste toner T1 overflows from the inner discharge port 1*r*. In the first posture of the waste toner-storing container 1, the gap between the backflow-preventing member 4 and the rear surface portion 1*c* is formed in the movement path m of the detection toner-storing section 1C. Therefore, the waste toner T1 falls in the second storing space R2 through the gap between the backflow-preventing member 4 and the rear surface portion 1*c*. The waste toner T1 falling in the second storing space R2 is deposited on the lower surface portion 1*v* as the waste toner T2.

The waste toner amount-detecting sensor 2 detects whether the height of the deposit of the waste toner T2 reaches h. For example, a detection signal that is high is output to the controller 110 if the height of the deposit of the waste toner T2 is lower than h and a detection signal that is low is output to the controller 110 if the height of the deposit of the waste toner T2 is equal to or greater than h. If the detection signal of the waste toner amount-detecting sensor 2 is low, the controller 110 determines that the waste toner-storing container 1 is completely filled. The controller 110 causes a display device to display a message warning that the waste toner-storing container 1 is completely filled. Moreover, the controller 110 perform control to prohibit a new image forming operation until the detection signal of the waste toner amount-detecting sensor 2 becomes high.

When the full state of the waste toner-storing container 1 is completely filled is displayed on the display device, the operator detaches the waste toner-storing container 1 from the printer 103 and exchanges the waste toner-storing container 1 by a new waste toner-storing container 1. It should be noted that there is a possibility that the operator doubts the full state of the waste toner-storing container 1 may shake the waste toner-storing container 1 and/or turn the waste toner-storing container 1 upside down and then reattach the detached waste toner-storing container 1 to the printer 103. If the full state of the waste toner-storing container 1 is not detected, the operator does not detach and shake the waste toner-storing container 1 and/or turn the waste toner-storing container 1 upside down. When the waste toner-storing container 1 is placed in the second posture other than the first posture, the direction of gravity acting on the waste toner T in the waste toner-storing container 1 changes. Therefore, the waste toner T flows within the waste toner-storing container 1. If the waste toner T2 flows back to the first storing space R1 of the main body section 1A from the second storing space R2 of the detection toner-storing section 1C, the amount of waste toner T2 in the second storing space R2 decreases. However, the total amount of waste toner T in the waste toner-storing container 1 does not change. In this case, even if the full state is detected before flowing back, the waste toner amount-detecting sensor 2 erroneously detects that it is not the full state due to the decrease in the amount of deposited waste toner T2 in the second storing space R2. However, since the waste toner-storing container 1 according to this embodiment includes the backflow-preventing member 4, such flowing back of the waste toner T2 is prevented.

For example, as shown in FIG. 4, when the waste toner-storing container 1 is in the second posture in which it is upside down, the backflow-preventing member 4 is rotated such that the weight portion 4*e* is substantially held in contact with the rear surface portion 1*n* due to the action of the moment due to gravity. At this time, the valve body 4*a* closes the movement path m. Therefore, the waste toner T2 located above the valve body 4*a* does not flow back to the first storing space R1 of the main body section 1A from the second storing space R2 of the detection toner-storing section 1C. Thus, even if the waste toner-storing container 1 is returned to the first posture and is reattached to the printer 103, the waste toner T2 of the second storing space R2 does not decrease. If the waste toner T2 does not flow back to the first storing space R1 by the time the waste toner-storing container 1 is returned to the first posture, the waste toner T2 may move into the movement path m beyond the valve body 4*a* in the second posture. For example, if the waste toner-storing container 1 is returned to the first posture from the second posture shown in FIG. 4, part of the waste toner T2 moves the movement path m beneath the valve body 4*a* with a certain gap formed between the valve body 4*a* and the rear surface portion 1*c*. In this case, the inner discharge port 1*r* is closed by waste toner T1' shown in FIG. 4. Therefore, even if the waste toner-storing container 1 is to the first posture, the waste toner T2 moving beneath the valve body 4*a* is returned to the second storing space R2 together with the waste toner T1'. In this case, when the waste toner-storing container 1 is reattached to the printer 103, the waste toner amount-detecting sensor 2 detects that the height of the deposit of the waste toner T2 is equal to or greater than h. Therefore, the full state is detected again.

As described above, in accordance with the waste toner-storing container 1 according to this embodiment, even if the waste toner T stored in the waste toner-storing container 1 flows due to the change of the posture of the waste toner-storing container 1, the full state of the waste toner T is prevented from being erroneously detected. Since the waste toner-storing container 1 includes the backflow-preventing member 4, the waste toner T2 of the second storing space R2 is prevented from flowing back to the first storing space R1 of the main body section 1A from the second storing space R2 of the detection toner-storing section 1C. Therefore, even if the waste toner-storing container 1 is reattached to the printer 103 after the operator shakes the waste toner-storing container 1 and/or turns the waste toner-storing container 1 upside down, the condition where the full state of the waste toner-storing container 1 is detected is not cancelled. As a result, image forming is not performed under the condition where the waste toner-storing container 1 is completely filled. Thus, the waste toner-discharging pipes 34 and 35 are prevented from being clogged and malfunctioning. Moreover, the waste toner T is prevented from overflowing from the waste toner-storing container 1.

Second Embodiment

Figure 5:
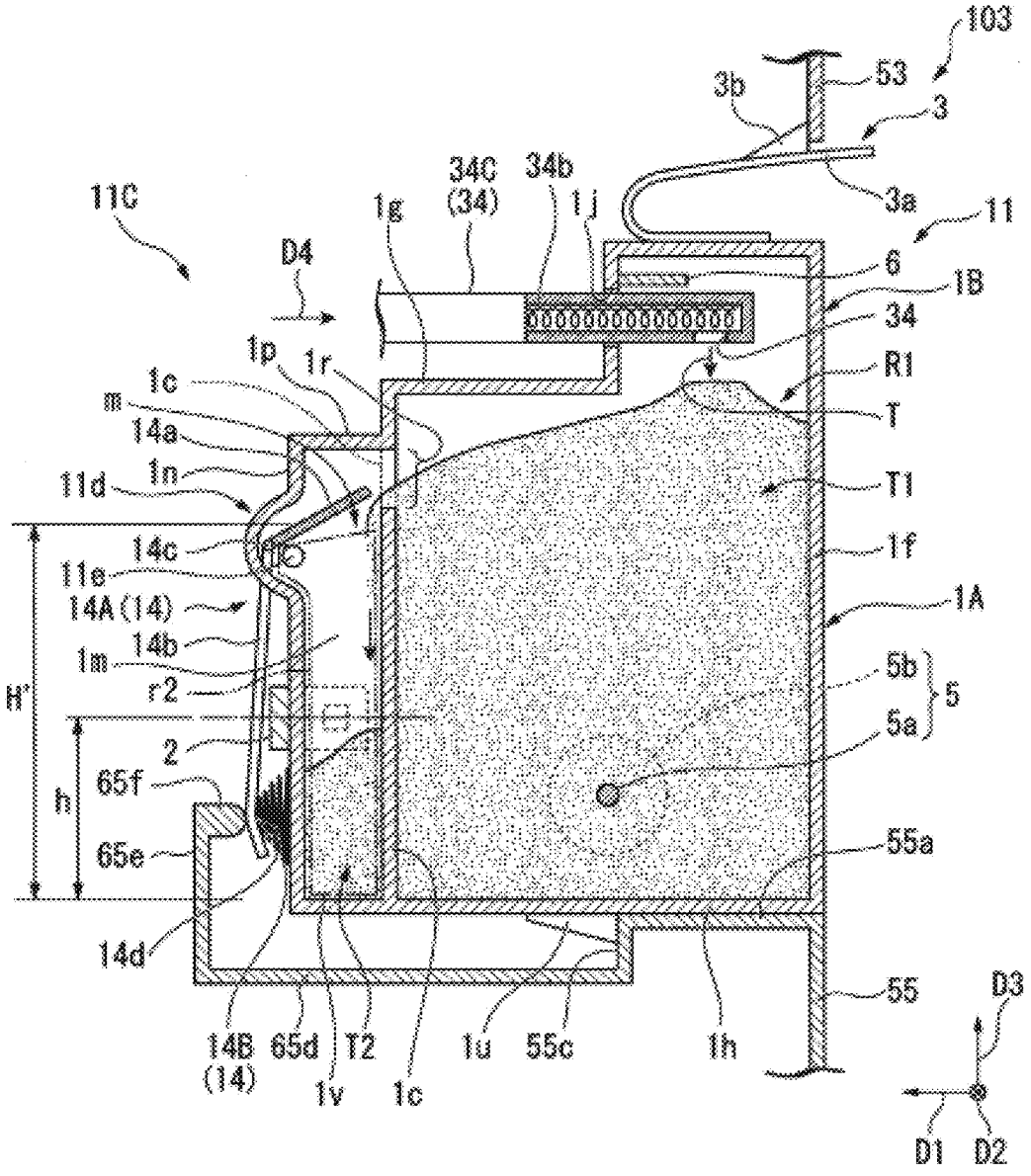
FIG. 5 is a cross-sectional view schematically showing a configuration example of a waste toner-storing container according to a second embodiment.

FIG. 5 schematically shows a configuration example of a waste toner-storing container 11 according to a second embodiment. As shown in FIG. 1, an image forming apparatus 200 according to this embodiment includes a waste toner-storing container 11 (container main body) instead of the waste toner-storing container 1 according to the first embodiment. Hereinafter, points different from the first embodiment will be mainly described.

As shown in FIG. 5, the waste toner-storing container 11 includes a detection toner-storing section 11C (second storing chamber) instead of the detection toner-storing section 1C of the waste toner-storing container 1 according to the first embodiment. As in the detection toner-storing section 1C, the detection toner-storing section 11C includes a lower surface portion 1*v*, side surface portions 1*m*, a rear surface portion 1*n*, and an upper surface portion 1*p*. As in the detection toner-storing section 1C, the detection toner-storing section 11C projects rearward from a rear surface portion 1*c* of a main body section 1A. In the rear surface portion 1*c* that the detection toner-storing section 11C faces, an inner discharge port 1*r* similar to that of the first embodiment is formed. It should be noted that the detection toner-storing section 11C includes a rotation support portion 11*d* instead of the bearing portion 4*d* of the detection toner-storing section 1C. The rotation support portion 11*d* is provided to face a part of the inner discharge port 1*r* and the rear surface portion 1*c* beneath the inner discharge port 1*r*. The rotation support portion 11*d* bulges rearward from the rear surface portion 1*n*. The rotation support portion 11*d* rotatably supports a backflow-preventing member 14. The backflow-preventing member 14 will be described later. A stopper 11*e* is provided inside the rotation support portion 11*d*. The stopper 11*e* is a protrusion that restricts the range of rotation of an actuator 14A in the clockwise direction in the figure. The actuator 14A will be described later.

At an inner bottom of the detection toner-storing section 11C, a second storing space R2 surrounded by the lower surface portion 1*v*, the side surface portions 1*m*, the rear surface portion 1*n*, and the rear surface portion 1*c* is formed beneath the lower end portion of the inner discharge port 1*r*. The second storing space r2 is similar to the second storing space R2 except for the fact that the second storing space r2 is formed in a range higher than that of the second storing space R2 according to the first embodiment. The difference between the height of the second storing space r2 and the height of the second storing space R2 is based on a difference between the movable range of the actuator 14A to be described later and the movable range of the backflow-preventing member 4 in the first embodiment. For example, the second storing space r2 is formed within a range of a height H' (where h<H<H') from the lower surface portion 1*v*. The height H' is lower than the lower end portion of the inner discharge port 1*r*. A space from the upper end of the second storing space r2 to the inner discharge port 1*r* is a movement path m through which waste toner T can pass.

The detection toner-storing section 11C includes the backflow-preventing member 14 instead of the backflow-preventing member 4 in the detection toner-storing section 1C according to the first embodiment. The backflow-preventing member 14 includes the actuator 14A and an elastic member 14B. The actuator 14A includes a valve body 14*a* (closing member), a rotating shaft 14*c*, and a lever 14*b*. The valve body 14*a* is a plate-like member rotatable within the movement path m and capable of closing the movement path m at a predetermined rotation angle. The rotating shaft 14*c* is provided at a first end portion of the valve body 14*a*. The central axis of the rotating shaft 14*c* is the center of rotation of the valve body 14*a*. The valve body 14*a* is rotatable until the valve body 14*a* comes into contact with the stopper lie from above in the clockwise direction in the figure. The valve body 14*a* closes the movement path m while the valve body 14*a* is held in contact with the stopper lie after the valve body 14*a* is rotated.

The rotating shaft 14*c* is rotatably supported by the rotation support portion 11*d* with the central axis extending the left and right directions. At least one of the both end portions of the rotating shaft 14*c* extends outside the rotation support portion 11*d*.

The lever 14*b* is coupled to the rotating shaft 14*c* with which the valve body 14*a* extends from the rotation support portion 11*d*. The lever 14*b* extends along the rear surface portion 1*n* downward while the valve body 14*a* shown in FIG. 5 is maximally rotated in the counter-clockwise direction in the figure. At this time, the valve body 14*a* is tilted in an oblique direction rising in the front direction. The position of the end of the valve body 14*a* in the upper and lower directions is higher than that of a lower end of the inner discharge port 1*r*. The backflow-preventing member 14 is formed in an approximately V-shape having the rotating shaft 14*c* as a top. A lower end portion 14*d* of the lever 14*b* is biased in a direction away from the rear surface portion 1*n* by the elastic member 14B to be described later.

The elastic member 14B biases the lower end portion 14*d* of the lever 14*b* in the direction away from the rear surface portion with elastic restoring force. The elastic member 14B is configured to bias the lever 14*b* in some degree also while the valve body 14*a* is held in contact with the stopper 11*e*. For example, a suitable biasing member that generates the elastic restoring force is used as the elastic member 14B. For example, a compression spring, helical extension spring, a helical torsion spring, a plate spring, an elastic material made of a rubber material or the like may be used as the elastic member 14B. For example, FIG. 5 shows an example in which the elastic member 14B is a conical compression spring having both ends coupled to the rear surface portion 1*n* and the lower end portion 14*d*. Hereinafter, the description will be given assuming that the elastic member 14B is the conical compression spring, for example.

The rotation position of the actuator 14A depends on balance between the elastic restoring force of the elastic member 14B which acts on the lever 14*b* and external force acting on the lever 14*b*. The printer 103 according to this embodiment includes a pressing portion 65*f* that presses the lever 14*b* of the actuator 14A forward when the waste toner-storing container 11 is attached to the printer 103. The pressing portion 65*f* is not particularly limited as long as the pressing portion 65*f* can press the lever 14*b* forward against elastic force of the elastic member 14B during attachment of the waste toner-storing container 11. In this embodiment, the pressing portion 65*f* is a protrusion protruding forward from a supporting plate 65*e*, for example. The supporting plate 65*e* is provided to be erected at a rear end of a flat plate portion 65*d* extending from a locking step 55*c* of a placement table portion 55.

Figure 6:
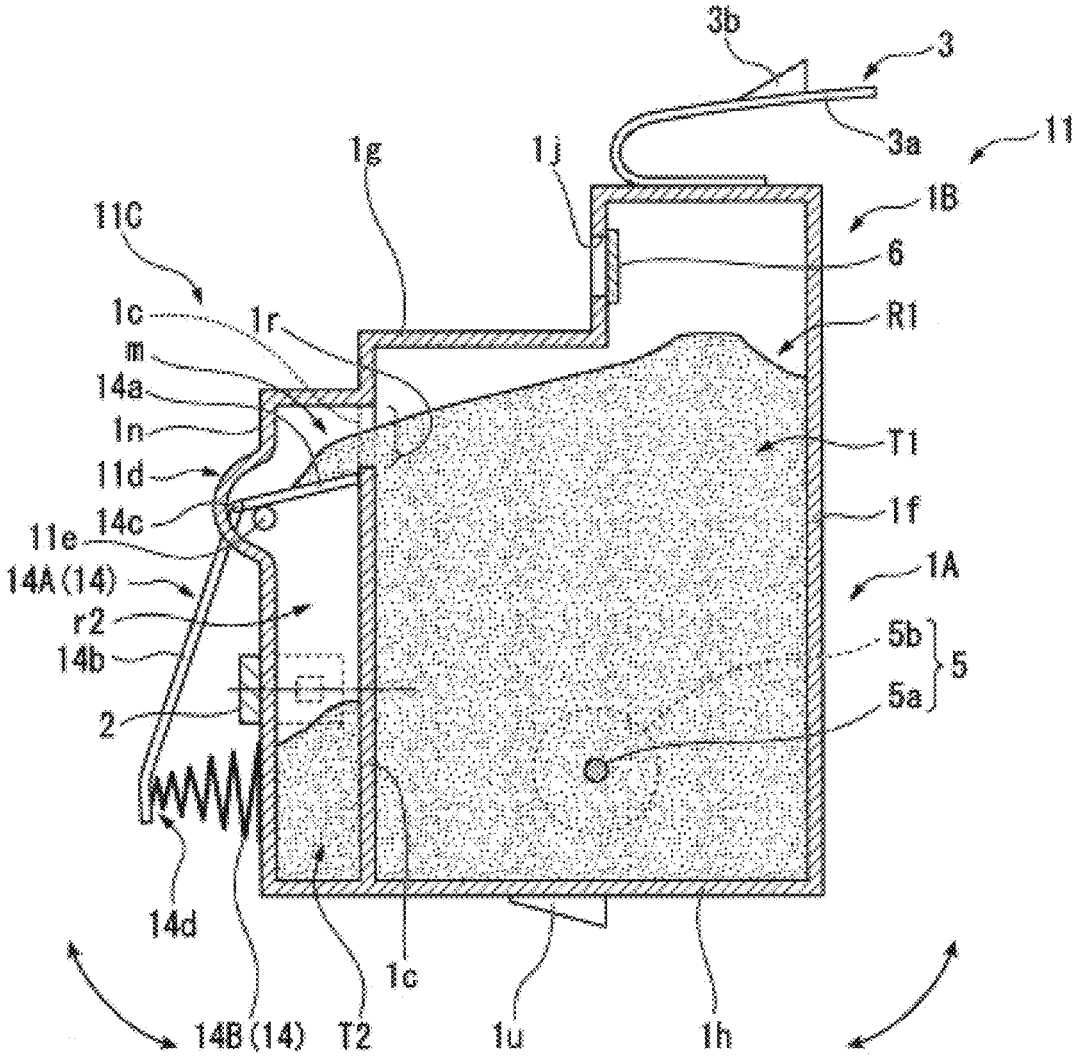
FIG. 6 is an operation explanatory diagram of the waste toner-storing container according to the second embodiment.

Next, points of the waste toner-storing container 11 in the image forming apparatus 200, which are different from the first embodiment, will be mainly described. FIG. 6 is an operation explanatory diagram of the waste toner-storing container according to the second embodiment.

As in the first embodiment, the waste toner-storing container 11 is attached to the printer 103 of the image forming apparatus 200. Under the attachment condition, the waste toner-storing container 11 is in the first posture. As shown in FIG. 5, in the first posture, the pressing portion 65*f* in the printer 103 presses the lower end portion 14*d* of the lever 14*b* forward. The elastic member 14B is compressed between the lower end portion 14*d* and the rear surface portion 1*n*. The actuator 14A is rotated in the counter-clockwise direction in the figure. The valve body 14*a* is spaced away from the rear surface portion 1*c*. The end of the valve body 14*a* moves to a position higher than the lower end of the inner discharge port 1*r*. A gap communicating with the second storing space r2 through the inner discharge port 1*r* is thus formed.

After the image forming apparatus 200 forms an image, the waste toner T is discharged to the waste toner-storing container 11 through waste toner-discharging pipes 34 and 35 as in the first embodiment. The waste toner T falls from the discharge ports 34*a* and is stored as waste toner T1 in the first storing space R1 as in the first embodiment. As shown in FIG. 5, when the upper surface of the deposit of the waste toner T1 exceeds the height of the lower end of the inner discharge port 1*r*, the waste toner T1 overflows from the inner discharge port 1*r*. The waste toner T1 falls into the second storing space r2 through the gap between the valve body 14*a* of the backflow-preventing member 14 and the inner discharge port 1*r*. The waste toner T1 falling in the second storing space r2 is deposited on the lower surface portion 1*v* as waste toner T2. The waste toner amount-detecting sensor 2 according to this embodiment performs full-state detection of the waste toner-storing container 11 as in the first embodiment.

In this embodiment, when the operator detaches the waste toner-storing container 11 from the printer 103, the pressing by the pressing portion 65*f* is cancelled. Therefore, as shown in FIG. 6, the lower end portion 14*d* is biased rearward by the elastic restoring force of the elastic member 14B. The actuator 14A of the backflow-preventing member 14 is rotated about the rotating shaft 14*c* in the clockwise direction in the figure. The valve body 14*a* comes into contact with the stopper lie. Then, the rotation of the actuator 14A is stopped. At this time, the valve body 14*a* closes the movement path m. In this manner, immediately after the waste toner-storing container 11 is detached from the printer 103, the waste toner-storing container 11 closes the movement path m with the valve body 14*a*. Therefore, even if the operator places the detached waste toner-storing container 11 in the second posture other than the first posture after the operator shakes the detached waste toner-storing container 11 and/or turns the detached waste toner-storing container 11 upside down, the waste toner T2 does not flow back to the first storing space R1. Even if the waste toner-storing container 11 is reattached to the printer 103, the waste toner T2 in the second storing space r2 does not decrease. Therefore, the condition where the full state is detected is not cancelled. In this embodiment, image forming is not performed under the condition where the waste toner-storing container 11 is completely filled. Therefore, the waste toner-discharging pipes 34 and 35 are prevented from being clogged and malfunctioning. Moreover, the waste toner T is prevented from overflowing from the waste toner-storing container 11.

As described above, in accordance with the waste toner-storing container 11 according to this embodiment, even if the waste toner T stored in the waste toner-storing container 1 flows due to the change of the posture of the waste toner-storing container 11, the full state of the waste toner T is prevented from being erroneously detected.

In accordance with at least one of the embodiments described above, it is possible to provide a waste toner-storing container and an image forming apparatus with which the full state of the waste toner can be prevented from being erroneously detected even if the waste toner stored in the waste toner-storing container flows due to the change of the posture of the waste toner-storing container.

It should be noted that the example in which the detection toner-storing section 1C or 11C is provided outside the main body section 1A has been described in each of the embodiments. Alternatively, the second storing chamber such as the detection toner-storing section 1C or 11C may be formed by providing a partition inside the main body section 1A, for example. In the second embodiment, the example in which the movement path m is closed in such a manner that the actuator 14A biased by the elastic member 14B is rotated about the rotating shaft 14*c* has been described. Alternatively, the backflow-preventing member 14 may include an actuator such as a shutter plate capable of opening and closing the inner discharge port 1*r* and an elastic member that slidingly moves the shutter plate.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A waste toner-storing container that stores waste toner discharged from an image forming apparatus, comprising:

a container main body that is removably attached to a main body of the image forming apparatus;

a first storing chamber that is provided in the container main body, the first storing chamber including an introduction port that receives waste toner discharged from the main body of the image forming apparatus when the container main body is attached to the main body of the image forming apparatus, and a first storing space capable of storing waste toner introduced through the introduction port;

a second storing chamber that is provided in the container main body, the second storing chamber including an inner discharge port through which waste toner from the first storing space overflows into the second storing chamber when the container main body is attached to the main body of the image forming apparatus, and a second storing space that stores the waste toner overflowed into the second storing chamber from the first storing space through the inner discharge port; and a backflow-preventing member that is provided between the inner discharge port and the second storing space and prevents the waste toner stored in the second storing space from moving into the first storing chamber, the backflow-preventing member comprising a closing member that moves, by its own weight, to a position where the closing member closes a movement path of the waste toner stored in the second storing space when the container main body is detached from the main body of the image forming apparatus and turned upside down.

2. The waste toner-storing container according to claim 1, wherein the second storing chamber includes the movement path through which the waste toner stored in the second storing space is movable by its own weight, the movement path being provided in a space between an upper end of the second storing space and the inner discharge port.

3. The waste toner-storing container according to claim 2, wherein the backflow-preventing member is provided in the movement path and prevents the waste toner stored in the second storing space from moving into the first storing chamber through the movement path when the container main body is detached from the main body of the image forming apparatus and turned upside down.

4. The waste toner-storing container according to claim 3, wherein the backflow-preventing member is moved to a position where the closing member does not close the movement path when the container main body is attached to the main body of the image forming apparatus.

5. The waste toner-storing container according to claim 3, wherein the backflow-preventing member is moved to a position where the closing member closes the movement path when the container main body is detached from the main body of the image forming apparatus and turned upside down.

6. The waste toner-storing container according to claim 3, wherein the closing member is, by its own weight, moved to the position where the closing member closes the movement path when the container main body is detached from the main body of the image forming apparatus and turned upside down.

7. The waste toner-storing container according to claim 6, wherein the closing member is rotatable by its own weight inside the movement path, and the closing member rotates to move between the position where the closing member closes the movement path and a position where the closing member does not close the movement path.

8. The waste toner-storing container according to claim 1, further comprising a waste toner amount-detecting sensor that detects an amount of waste toner stored in the second storing chamber.

9. A waste toner-storing container that stores waste toner discharged from an image forming apparatus, comprising:

a container main body that is removably attached to a main body of the image forming apparatus;

a first storing chamber that is provided in the container main body, the first storing chamber including an introduction port that receives waste toner discharged from the main body of the image forming apparatus when the container main body is attached to the main body of the image forming apparatus, and a first storing space capable of storing waste toner introduced through the introduction port;

a second storing chamber that is provided in the container main body, the second storing chamber including an inner discharge port through which waste toner from the first storing space overflows into the second storing chamber when the container main body is attached to the main body of the image forming apparatus, and a second storing space that stores the waste toner overflowed into the second storing chamber from the first storing space through the inner discharge port; and a backflow-preventing member that is provided between the inner discharge port and the second storing space and prevents the waste toner stored in the second storing space from moving into the first storing chamber, wherein the backflow-preventing member includes a closing member capable of closing a movement path of the waste toner stored in the second storing space, an elastic member that applies biasing force on the closing member in a direction in which the closing member closes the movement path, and a lever that is provided outside the container main body and is capable of moving the closing member in a direction in which the closing member does not close the movement path against the biasing force of the elastic member.

10. An image forming apparatus, comprising:

a printer that forms an image with toner and discharges waste toner; and a waste toner-storing container that stores waste toner discharged from the printer, the waste toner-storing container including a container main body that is removably attached to a main body of the image forming apparatus, a first storing chamber that is provided in the container main body, the first storing chamber including an introduction port that receives waste toner discharged from the main body of the image forming apparatus when the container main body is attached to the main body of the image forming apparatus, and a first storing space capable of storing waste toner introduced through the introduction port, a second storing chamber that is provided in the container main body, the second storing chamber including an inner discharge port through which waste toner from the first storing space overflows into the second storing chamber when the container main body is attached to the main body of the image forming apparatus, and a second storing space that stores the waste toner overflowed into the second storing chamber from the first storing space through the inner discharge port, and a backflow-preventing member that is provided between the inner discharge port and the second storing space and prevents the waste toner stored in the second storing space from moving into the first storing chamber, wherein the backflow-preventing member includes a closing member capable of closing a movement path of the waste toner stored in the second storing space, an elastic member that applies biasing force on the closing member in a direction in which the closing member closes the movement path, and a lever that is provided outside the container main body and is capable of moving the closing member in a direction in which the closing member does not close the movement path against the biasing force of the elastic member.

* * * * *